United States Patent [19]

Takeuchi et al.

[11] 4,371,149

[45] Feb. 1, 1983

[54] APPARATUS FOR COOLING SHEET STEEL BY WATER SPRAYING

[75] Inventors: Osamu Takeuchi, Mitaka; Haruo Kokubun, Yokosuka; Hisashi Yoshinaga, Osaka; Shuichi Hara, Izumisano; Hiromichi Ban, Osaka, all of Japan

[73] Assignees: Ishikawajima-Harima Jukogyo Kabushiki Kaisha, Tokyo; Sumitomo Metal Industries, Ltd., Osaka, both of Japan

[21] Appl. No.: 169,508

[22] Filed: Jul. 21, 1980

[30] Foreign Application Priority Data

Nov. 9, 1979 [JP] Japan ..... 54-145098

[51] Int. Cl.[3] ..... C21D 11/00

[52] U.S. Cl. ..... 266/90; 266/113; 266/115; 266/117

[58] Field of Search ..... 266/113, 115, 117, 119, 266/121, 90, 102, 114

[56] References Cited

U.S. PATENT DOCUMENTS 3,546,911 12/1970 Lenz ..... 266/117

3,997,376 12/1976 Hemsath et al. ..... 266/113

*Primary Examiner*—R. Dean

*Attorney, Agent, or Firm*—Alfred E. Miller

[57] ABSTRACT

Cooling water is sprayed under a predetermined pressure range and at a predetermined discharge rate over the both surfaces of a sheet to be treated which is reciprocated lengthwise at such a velocity that the product of the reciprocating velocity and thickness of the sheet may be maintained within a predetermined range. The spraying direction of each spray nozzle is individually controlled so that any water remaining over the surface of the sheet may be expelled out. The method and apparatus is especially adapted for use in the normalizing process and in the process for cooling hot-rolled sheet steel.

6 Claims, 8 Drawing Figures

APPARATUS FOR COOLING SHEET STEEL BY WATER SPRAYING

BACKGROUND OF THE INVENTION

The present invention relates to a method and apparatus for cooling sheet steel or the like with water sprays.

In general, the cooling treatments of sheet metal must be accomplished in normalizing treatments and after hot rolling. The principal objectives in normalizing treatments are grain refinement, stress relief and chemical homonization, whereby desired mechanical strength such as ductility may be obtained. The hot-rolled sheet metal must be cooled to a uniform temperature without being quenched so that the succeeding processing of hot-rolled sheet metal may be facilitated and consequently high productivity may be attained.

In the case of normalizing process, the sheet metal is heated above an austenitic transformation temperature and then is cooled. If the cooling rate can be varied within the range in which quenching will not result; that is, if the cooling rate may be optimumly selected depending upon the composition of the sheet metal to be subjected to the normalizing treatment, the back cooling table can be made compact in size and, furthermore, the safeguarded operation may be ensured because the time period for leaving the high-temperature sheet steel on the table may be considerably shortened.

In the cooling treatment both in the normalizing process and after the hot rolling process, care must be taken to eliminate the danger of distorting the shape of the sheet.

The methods for cooling the high-temperature sheet steel may be divided into the air cooling, forced cooling and water cooling methods as will be described in detail below. Recently there has been devised and demonstrated a cooling method in which the water is mixed with a suitable atomizing agent such as air or steam and sprayed over the surfaces of the hot sheet steel.

(i) Air Cooling:

Hot sheets are left on the cooling stand or table and are cooled with air. The thermal conductivity of air is however on the order of 80 kcal/m$^2$·hr·°C. so that the cooling rate is very slow. As a result, the cooling stands or tables considerably large in size must be used. In addition, by air cooling the grain refinement is limited.

(ii) Forced Air Colling:

This is the method in which a large amount of air is forcibly blown against the surfaces of the hot sheet steel with the use of a blower or the like. However, the thermal conductivity between the sheet steel and the air is on the order of 100 kcal/m$^2$·hr·°C. at the highest so that the same problems as encountered in the air cooling arise.

(iii) Water Spray Cooling:

The water is sprayed through the nozzles of metal pipes against the surfaces of the hot sheet steel. This method has been so far used for hardening treatments. However, the prior art water spraying apparatus cannot attain the complete atomization of water so that the water drops and jets are impinged against the surfaces of the sheet steel. As a result, it is difficult to reduce the thermal conductivity between the sheet steel and cooling water below 1,000 kcal/m$^2$·hr·°C. Furthermore, the portions impinged with water droplets are quenched or hardened. In addition, since the water spray cooling apparatus has been used for quenching, cooling water must be sprayed at a high flow rate of from 500 to 5,000 l/m$^2$·min. With the prior art water spraying apparatus, it is very difficult to control the water spray rate to less than 100 l/m$^2$·min.

(iv) Water Spray Cooling with Atomizing Agent such as Air or Vapor:

This method has been recently devised and is advantageous in that the cooling rate may be varied over a wide range, but disadvantageous in that a large quantity of atomizing agent is required and the additional energy for atomizing water must be provided. That is, when the air is used as an atomizing agent, the air of from 300 to 400 l is required for atomizing 1 l of water. This means that the energy of 2,500 W must be supplied to a compressor so as to raise the pressure of air of 300 l to 6 kg/cm$^2$ in order to atomize 1 l of water per minute. On the other hand, according to the present invention, only 50 W is supplied to a pump in order to obtain the nozzle pressure of 10 kg/cm$^2$. That is, the power consumption of the prior art water spraying method is as high as 50 times. Furthermore, the prior art water spraying method presents the noise problem because when the atomizing agent flows through the nozzles at high velocities, noise as high as from 90 to 110 dB is produced.

The above-described water spray cooling methods (iii) and (iv) have some common problems to be described below.

In the sheet steel production line, the sheets are transported over the horizontal tables or the like from one station to another. As a result, the cooling apparatus must be horizontal; that is, the cooling water is sprayed vertically against the upper and lower surfaces of the sheet. In this case, the water spread against the lower surface of the sheet drops therefrom by gravity so that no problem arises, but the cooling water sprayed over the upper surface remains there, forming heat-insulating layers against the cooling water. As a result, the cooling water must absorb the heat from the upper surface of the sheet through these layers of remaining water so that the effective cooling cannot attained. Furthermore, the remaining cooling water will not form a layer in uniform thickness over the whole surface so that the uniform cooling of the upper surface is impossible.

In the case of water spray cooling of the sheet steel which has been heated to the temperatures higher than 100° C., layers or films of vapor are formed between the cooling water and the sheet steel. This vapor film formation is different between the upper and lower surfaces mainly because of the difference in amount of water remaining on the upper and lower surfaces. Furthermore, vapor layer or film formation also differs even over the same surface because of the non-uniform temperature distribution. As a result, local heat transfer rates between the cooling water and the sheet metal vary almost from one point to another. Thus, because of the non-uniform cooling with the resultant non-uniform local heat transfer rates, distortion of the sheet metal results. Furthermore, distortion causes the change in pattern of cooling water remaining over the upper surface so that the cooling conditions change or become worse. As a consequence, the cooled sheet steel cannot have the uniform structure. That is, the production of sheet steel with high qualities cannot be attained. So far the distorted sheet steel has been straightened or corrected by a leveler or the like.

The present invention was made to overcome the above and other problems encountered when the sheet metal or steel which has been heated to high temperatures is cooled with water sprays.

The primary object of the present invention is therefore to provide a method and apparatus in which an optimum coefficient of heat transfer from sheet steel to cooling water may be obtained by controlling the transportation speed of sheet steel, the water spraying rate (that is, the rate at which the cooling water is sprayed), the pressure of cooling water at nozzles and the spray angle, whereby the sheet steel may be uniformly cooled without causing distortion of the shape.

The above and other objects, features and advantages of the present invention will become more apparent from the following description of a preferred embodiment thereof taken in conjunction with the accompanying drawings.

DETAILED DESCRIPTION OF THE PREFERRED EMBODIMENT

Figure 1:
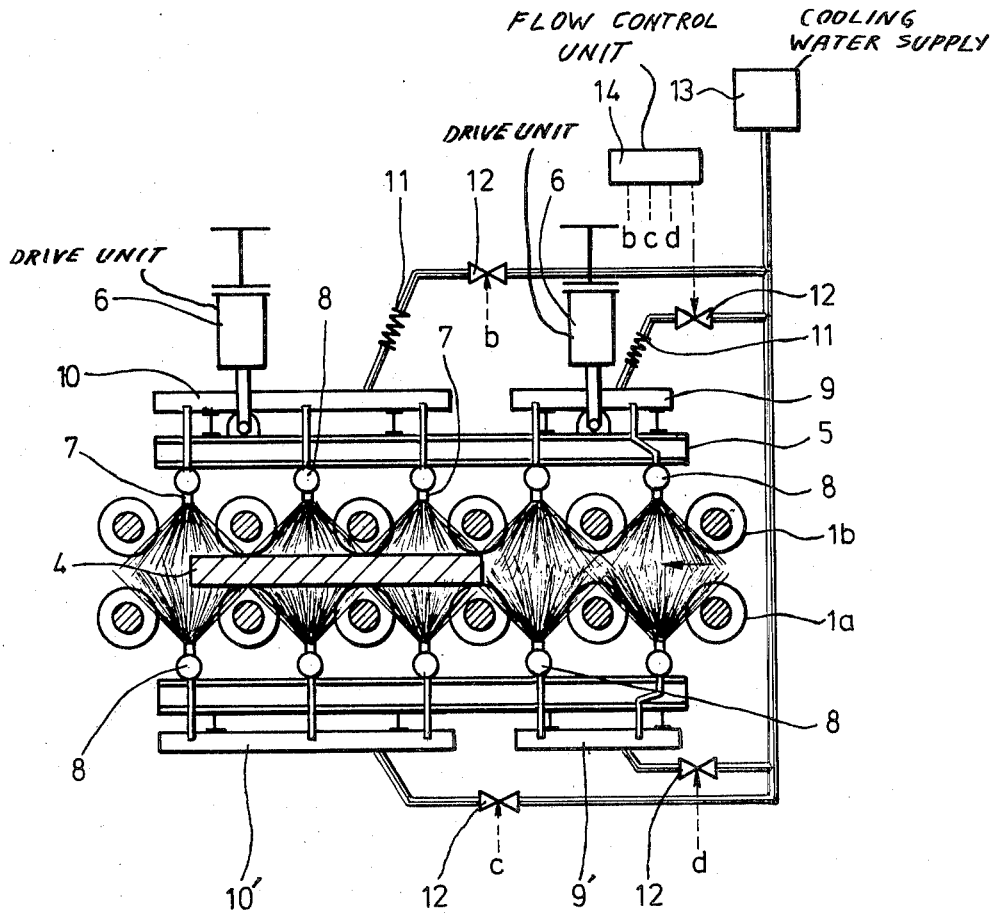
FIG. 1 is a side view of a cooling apparatus in accordance with the present invention.
Figure 2:
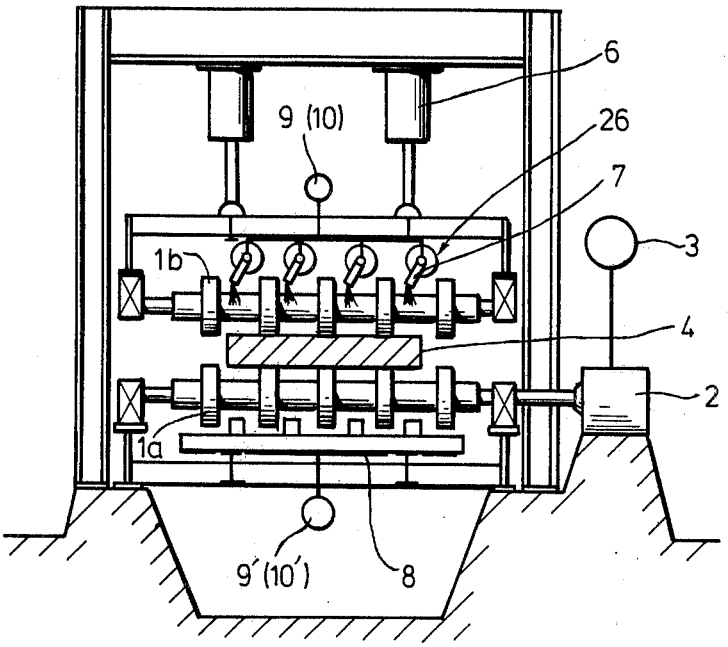
FIG. 2 is a front view thereof.

Referring to FIGS. 1 and 2, an apparatus for cooling sheet steel by water spraying in accordance with the present invention has a lower wheel conveyor section 1*a* and an upper wheel conveyor section 1*b*, each section consisting of a plurality of through-shaft-mounted wheels. The lower wheel conveyor section 1*a* is drivingly connected to a drive unit 2 such as an electric motor which in turn is operatively connected to a reversible drive control unit 3 so that a sheet steel 4 on the lower wheel conveyor section 1*a* may be reciprocated for the purposes to be described below.

The upper wheel conveyor section 1*b* is suspended from a vertically movable frame 5 in symmetrical relationship with the lower wheel conveyor section 1*a*. The movable frame 5 is vertically movably mounted on a portal framework through an up-and-down drive unit 6 consisting of for instance power cylinders in this embodiment so that the upper wheel conveyor section 1*b* may be moved toward or away from the lower wheel conveyor section 1*a* depending upon the thickness or gage of the sheet 4.

The cooling apparatus further includes a lower cooling water spraying system disposed immediately below the lower wheel conveyor section 1*a* and an upper cooling water spraying system disposed immediately above the upper wheel conveyor section 1*b* in symmetrical relationship with the lower spraying system and mounted also on the movable frame 5 so that the upper spraying system may be moved up and down in unison with the upper wheel conveyor section 1*b*.

The lower and upper spraying systems are substantially similar both in construction and mode of operation so that it may suffice to describe only the upper water spraying system for the understanding of the present invention. The upper water spraying system comprises a matrix array of water spray nozzles 7 which are shown in FIGS. 1 and 2 as being arranged four in widthwise or column and six in lengthwise or row ($4\times6=24$). The four spray nozzles in the same column are hydraulically communicated with a common distribution pipe 8 extended widthwise. It should be noted that according to the present invention these spray nozzles 7 are divided into at least two groups. That is, in this embodiment, they are divided into a front group consisting of the spray nozzles 7 in the first and second columns (from the right in FIG. 1) which are hydraulically connected through their respective distribution pipes 8 to a common front header 9 and a rear group consisting of the spray nozzles 7 in the third through fifth columns which are also hydraulically connected through their respective distribution pipes 8 to a common header 10. The front spray nozzle group on the entrance side of the cooling apparatus is smaller in number than the rear group of spray nozzles 7.

The number of the headers 9 and 10, which are lengthwise mounted on the movable frame 5, therefore must correspond to the number of groups into which are divided the spray nozzles 7. Both the headers 9 and 10 are connected through flexible joints such as flexible hoses 11, flow control valves 12 and supply pipes to a common cooling water supply source 13, which supplies the cooling water under pressure to the spray nozzles 7. The flow control valves 12 are operatively connected to a flow rarte control unit 14 so that the discharge rate of each spray nozzle group may be optimumly controlled independently of the other groups. For instance, in this embodiment, in response to the control from the flow control unit 14, each flow control valve 12 can control the flow rate from 5 to 50 $l/m^2$-min.

Figure 3:
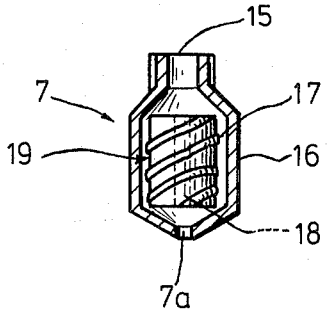
FIG. 3 is a longitudinal sectional view of a water spraying nozzle used in the apparatus shown in FIGS. 1 and 2.

Next referring to FIG. 3, the construction of the spray nozzle 7 especially adapted for the objects of the present invention will be described in detail. Briefly stated, the construction of the spray nozzle 7 shown in FIG. 3 is such that the cooling water fed into an inlet 15 is divided into two flows having different vectors (that is, into two flows flowing in different directions) and two flows or jets strike against each other just within an orifice 7*a*. The break-up of cooling water is therefore mainly due to this impact and the resulting turbulance.

Still referring to FIG. 3, the spray nozzle 7 has a hollow body 16 in which is disposed a cylindrical deflector 19 with a helical ridge 17 and an axial passage 18. Therefore, the cooling water fed into the inlet 15 is divided into the axial flow passing through the axial passage 18 and the rotating or swirling flow along the helical passage. Just within the orifice 7*a*, the axial jets strike the rotating fluid so that due to this impact and the resulting turbulence, the break-up results.

Figure 4:
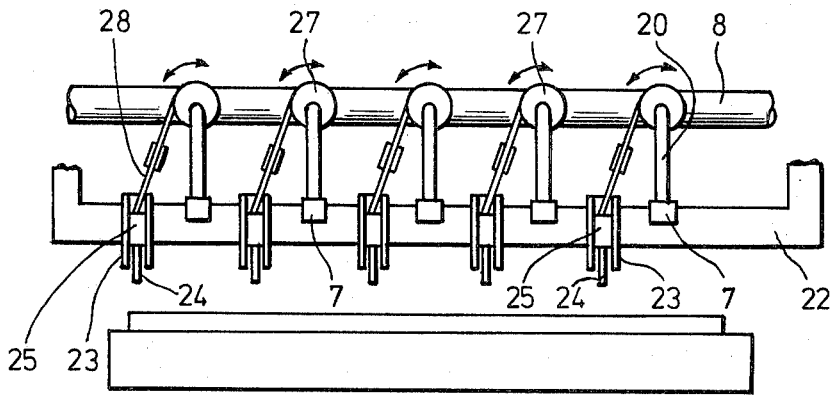
FIG. 4 is a front view of a nozzle holder.

Next referring to FIGS. 4 and 5, a mechanism for controlling the angular position of the spray nozzle 7 will be described in detail. The spray nozzle 7 is fitted to the lower end of a 90° long turn elbow 20 which in turn is hydraulically connected through a flexible rotation joint 21 to the distribution pipe 8. Instead of the flexible rotation joint, any suitable flexible joint may be used which, as will be described below, permits the rotation through a small angle of the elbow 20 and hence the nozzle 7 in the directions indicated by the arrows in FIGS. 4 and 5(*a*).

The elbow 20 carrying the spray nozzle 7 at its lower end is operatively coupled to a "touch" or feeler roll 24 through a slider-block linkage 26 consisting of a disk 27 securely mounted on the horizontal portion of the elbow 20 for rotation in unison therewith, a slider 25, which is vertically reciprocally slidable in a slideway or guide block 23 mounted on a supporting frame 22 extended in parallel with and below the distribution pipe 8, and a connecting rod 28 interconnecting between the disk 27 and the upper end of the slider 25. The "touch" or feeler roll 24 is rotatably mounted at the lower end of the slider 25. Therefore, as the slider 25 moves up and down as will be described below, the disk 27 is caused to rotate through a small angle so that the spray nozzle 7 may swing or oscillate through the angle from 0° to 70° relative to the vertical.

Figure 5A:
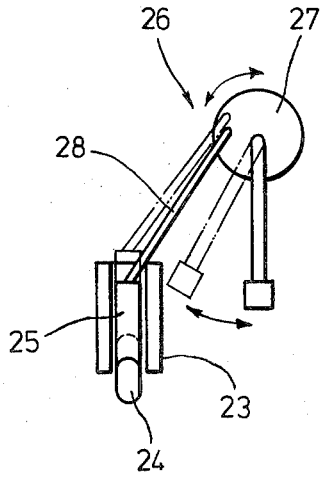
FIGS. 5(*a*) and (*b*) are detailed views thereof used for the explanation of the mode of operation thereof.
Figure 5B:
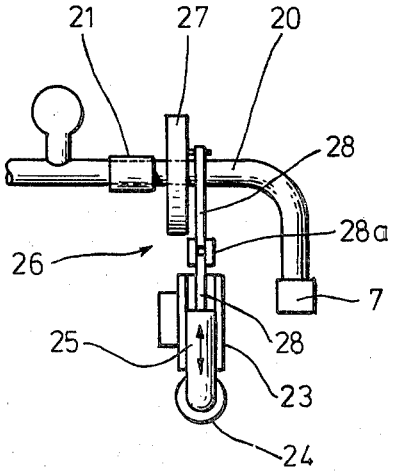

Instead of the connecting rod 28 with a predetermined length which cannot be changed, it may be comprised of two sections interconnected with a turnbuckle-like sleeve nut 28*a* as shown in FIG. 5(*b*), the nut 28*a* having the upper and lower internally but oppositely threaded screw threads. Therefore the length of the connecting rod 28 may be increased or decreased so that the spray nozzle 7 can be set to an optimum initial angular position.

Next referring back to FIGS. 1 through 5, the mode of operation of the cooling apparatus with the above construction will be described in detail. The sheet 4 to be treated enters the reciprocating path between the lower and upper wheel conveyor sections 1*a* and 1*b* as indicated by the arrow in FIG. 1 and is caused to reciprocate lengthwise under the control of the reversible drive control unit 3. The flow rates of the cooling water under pressure supplied from the water supply source 13 to the respective groups of spray nozzles 7 are controlled by the flow control valves 12, whereby the discharge rates of the respective spray nozzle groups may be controlled independently of each other. The cooling water is sprayed over both the surfaces of the sheet 4 which is reciprocated between the lower and upper wheel conveyor sections 1*a* and 1*b* so that the variation in discharge rate among the spray nozzles 7 in the same group can be compensated for and, consequently, the sheet 4 may be uniformly cooled and avoided from deformation. In addition, the load of the sheet 4 being cooled may be uniformly distributed over the wheels so that the deformation of the latter may be also avoided.

When the axis of the spray nozzle 7 is initially inclined at an angle relative to the vertical in the manner described with reference to FIGS. 4 and 5, the water droplets impinge against the surface of the sheet at angles relative to the vertical so that the horizontal components of the impinging forces of the water droplets act on the water remaining over the surface of the sheet 4 in such a way that the remaining water is forced to flow along the surface towards the edges of the sheet 4. As a result, the water remaining over the surface may be minimized in quantity or almost eliminated so that uniform cooling may be ensured and consequently distortion of the shape of the sheet 4 may be avoided.

As described above, according to the present invention, the deformation of the sheet 4 may be minimized or almost eliminated during the cooling process, but if distortion in excess of allowable tolerances should occur, the mechanism for controlling the angular position of spray nozzles 7 can effectively correct such deformation. That is, the "touch" or feeler rollers 24 are vertically spaced apart from the upper surface of the sheet 4 by a predetermined distance. Therefore when the sheet 4 should warp in excess of a predetermined tolerance range, it makes into contact with some of the "touch" or feeler rolls 24 and pushes them upward so that the corresponding spray nozzles 7 are caused to swing or oscillate in the manner described elsewhere and, consequently, the direction of the water spray changes. As a result, the water in the pools, which have resulted from warping of the sheet 4, can be blown away under the forces of water sprays. Thus the nonuniform cooling due to the water remaining over the surface of the sheet can be also avoided and the flatness of the sheet 4 can be maintained to a desired degree of tolerance.

As described previously, the spray arrays 7 are divided into at least two groups and the discharge rate of each group can be controlled independently of each other so that the cooling rate can be suitably controlled or changed even during the cooling process and, consequently, the properties of the sheet can be controlled. For instance, the discharge rate of the spray nozzles 7 in the front group may be selected greater than those of the spray nozzles 7 in the rear group so that the sheet 4 may be cooled at a faster cooling rate when it enters the apparatus and then at a slower cooling rate as it is conveyed toward the discharge end (to the left).

The spacing between the lower and upper wheel conveyor sections 1*a* and 1*b* and the distance between the nozzles 7 and the upper surface of the sheet 4 can be suitably controlled depending upon the thickness or gauge of the sheet by actuating the up-and-down drive unit 6. Therefore, regardless of the thickness or gage of sheets to be treated, they may be reciprocated in an optimum manner during the cooling process and the uniform cooling may be ensured on both the upper and lower surfaces.

After the sheet 4 has been cooled to a predetermined temperature in the manner described above, the reversible drive control unit 3 switches the drive unit 2 so that the cooled sheet may be discharged from the left side of the cooling apparatus in FIG. 1.

The mode of operation will be described in more detail with some actual data. The flow or discharge rate per unit area of the sheet to be treated is varied from 5 to 50 $l/m^2 \cdot min$ and the orifice spray pressure is varied from 0.5 to 20 $kg/cm^2$ while the value of $v \times t$ is maintained between 20 and 150 mm·m/min, where v = the reciprocating velocity of the sheet in mm·m/min and t = the thickness of the sheet in mm. When the cooling operations are carried out under the above conditions, the sheets can be satisfactorily cooled without being quenched; that is, without resulting in any undesired structure transformation by quenching.

The range of the reciprocating velocity between 20 and 150 mm·m/min is selected because of the reason below. That is, uniform cooling of a sheet is dependent upon the thickness and the reciprocating velocity of the sheet. When the sheet to be treated has a small thickness, the faster the reciprocating velocity, the less the deformation of the sheet results. The experiments showed that when the product $v \times t$ is between 20 and 150 mm·m/min, distortion is minimum.

When the discharge rate is less than 5 $l/m^2 \cdot min$, the cooling rate becomes too slow and is even slower than that attained by the forced cooling described previously. On the other hand, when the discharge rate exceeds 50 $l/m^2 \cdot min$, the cooling rate becomes too fast so that the sheet steel is quenched. Therefore, the discharge rate for attaining the satisfactory results by normalizing treatments is between 5 and 50 $l/m^2 \cdot min$.

In order to determine the optimum range of the nozzle pressure between 0.5 and 20 $kg/cm^2$, extensive studies and experiments were conducted by varying the orifice size and the discharge rate between 5 and 50 $l/m^2 \cdot min$. The size of water droplets for cooling sheet steel in normalizing treatments must be less than 700 $\mu m$. If the nozzle pressure is less than 0.5 $kg/cm^2$, a uniform spatial distribution cannot be attained. With the discharge rate of 50 $l/m^2 \cdot min$, a satisfactory spatial distribution with the droplet size of less than 700 $\mu m$ can be attained at a nozzle pressure less than 20 $kg/cm^2$ which is the upper limit in accordance with the present invention. Noteworthy improvements of the spatial distribution cannot be attained even when the nozzle pressure is increased beyond 20 $kg/cm^2$, but only the increase in power for raising the nozzle pressure results.

The swinging or oscillating angle range of the spray nozzle 7 is selected between 0° and 70° because when the spray nozzle 7 is swung beyond 70°, alsmot no water droplet will impinge against the sheet steel being treated.

Next some effects, features and advantages accrued from the method and apparatus in accordance with the present invention will be described. In the case of cooling of the sheet steel which had been heated above an austenitic transformation temperature with the cooling apparatus and method described previously, it was found that satisfactory normalization can be attained when the coefficient of heat transfer is between 100 and 800 $kcal/m^2 \cdot hr \cdot °C.$, which is considerably higher. The coefficient of heat transfer can be varied suitably within the range from 100 to 800 $kcal/m^2 \cdot hr \cdot °C.$ when the product $(v \times t)$ is from 20 to 150 $mm \cdot m/min$; the discharge rate is from 5 to 50 $l/m^2 \cdot min$; and the nozzle pressure is from 0.5 to 20 $kg/cm^2$. Under these conditions, the sheet steel can be normalized uniformly at a suitable cooling rate without being any local quenching.

Figure 6:
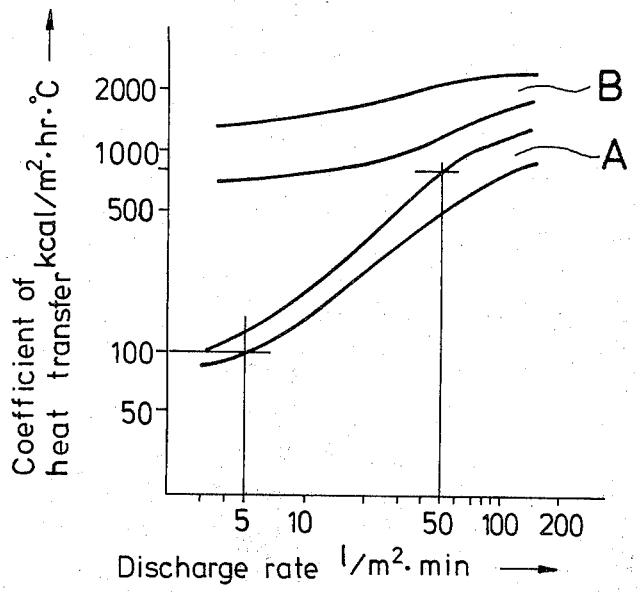
FIG. 6 is a graph showing the relationship between the water spraying rate and the coefficient of heat transfer.

The relationship between the discharge rate and the coefficient of heat transfer is shown in FIG. 6. The range A shows the local and overall coefficients of heat transfer obtained when the cooling water is sprayed at the discharge rate between 5 and 50 $l/m^2 \cdot min$ so that sheet steel can be normalized without being quenched. The range B shows the local coefficients of heat transfer attained when the cooling water jets are impinged against the sheet being treated without being sprayed or atomized. It is clearly seen that the prior art cooling methods in which the cooling water jets are impinged against the sheet steel without being atomized cannot attain the effects and features of the method and apparatus of the present invention.

Figure 7:
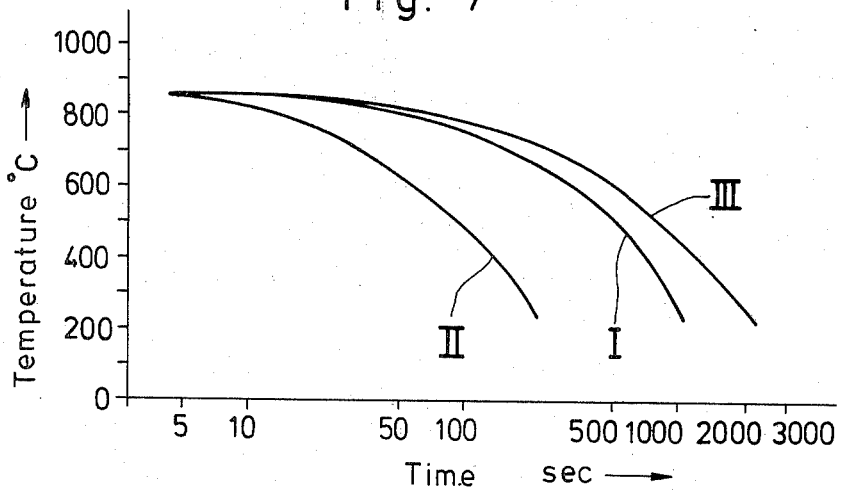
FIG. 7 is a graph showing the cooling rate at the center of the sheet steel of 35 mm in thickness.

Comparison in cooling rate at the center of the sheet steel of 35 mm in thickness between the air cooling and the method of the present invention was made. The results are shown in FIG. 7, in which the curve I shows the cooling rate when the sheet steel was cooled by the method of the present invention at the discharge rate of 5 $l/m^2 \cdot min$; the curve II, the cooling rate when the discharge rate was 50 $l/m^2 \cdot min$; and the curve III, the cooling rate when the air cooling was used.

It is seen that the time required for cooling one sheet from 850° to 300° C. is 2,000 seconds by the air cooling method and 1,000 and 200 seconds, respectively, by the method of the present invention at the discharge rates of 5 $l/m^2 \cdot min$ and 50 $l/m^2 \cdot min$, respectively. Assume that it require to cool ten sheets of steel of 10 m in length and 35 mm in thickness for 2,000 seconds. Then when the air cooling method III is used, the cooling table of 100 m in length is required, but when the method of present invention is employed with the discharge rate of 50 $l/m^2 \cdot min$, it suffices to provide the cooling apparatus of 10 m in length and a cooling table of 10 m in length onto which is delivered the sheet steel from the cooling apparatus for handling by a crane. Thus the overall length can be reduced to 1/5 as compared with the air cooling method.

The effects, features and advantages of the present invention may be summarized as follows:

(i) When for instance a sheet steel of 35 mm in thickness is cooled from 850° C. to 300° C., the cooling rate or the coefficient of heat transfer may be suitably selected in the range from 100 to 800 $kcal/m^2 \cdot hr \cdot °C.$ by suitably varying the discharge rate between 5 and 50 $l/m^2 \cdot min$ on both the surfaces, whereby in the cooling step in the normalizing treatment an optimum cooling rate may be selected depending upon the properties of the sheet steel to be treated.

(ii) Because of (i), an optimum cooling rate can be selected which is by far faster than that attainable by the air cooling method. As a result, the overall length of the cooling station; that is, the cooling apparatus and the discharge table can be considerably shortened as described previously.

(iii) The cooling water is sprayed through the nozzles at the discharge rate of from 5 to 50 $l/m^2 \cdot min$ and at the nozzle pressure of from 0.5 to 20 $kg/cm^2$ as described elsewhere. In this case, the cooling water fed into the inlet of the spray nozzle is divided into two flows with different vectors; that is, the water is divided into the axial jet and the whirling or rotating jet, and these two jets strike each other just within the orifice of the spray nozzle. As a result, the water can be broken up into droplets of less than 700 $\mu m$ in diameter. Thus finely atomized water droplets are impinged against the both surfaces of the sheet steel being treated so that uniform cooling without accompanying with any local quenching may be attained. In addition, the cooling rate or the coefficient of heat transfer may be varied within the range between 100 and 800 $kcal/m^2 \cdot hr \cdot °C.$ by changing only the discharge rate and the nozzle pressure within the above specified ranges, respectively. In addition, as compared with the prior art cooling methods and apparatus, considerable reduction in water consumption can be attained.

(iv) Cooling water can be completely atomized only under the pressure without the use of any atomizing agent. As a result, the power required for mixing the atomizing agent with the cooling water can be eliminated. In addition, noise generation can be suppressed to a considerably lower level.

(v) The spray nozzles are divided into at least two groups in the lengthwise direction of the cooling apparatus so that cooling conditions may be changed even during the cooling process.

(vi) Because of the use of the wheel conveyor sections, what is essentially point support is given to the sheet steel so that the adverse effects on the uniform cooling of the sheet steel due to the cooling of the rollers will not result.

(vii) The upper nozzles can be simultaneously vertically moved toward or away from the upper surface of the sheet steel being treated so that the uniform surface cooling conditions may be maintained regardless of the thickness or gage of sheets to be treated.

(viii) The axis of the spray nozzle can be automatically changed when the sheet being treated should warp during the cooling process in such a way that warping may be eliminated or suppressed within the allowable tolerance range.

(ix) Grain refinement can be attained to such a higher degree hithereto unattainable by any prior art methods and apparatus and, furthermore, a higher degree of ductility may be attained. As a result, even when the quantities of alloying metals are reduced, sheet steel with desired mechanical and chemical properties can be produced. In addition, with decrease in quantities of alloying metals the carbon equivalent can be reduced so that weldability can be improved considerably.

What is claimed is:

1. An apparatus for cooling sheet steel by water spraying comprising (a) a lower wheel conveyor section, (b) an upper wheel conveyor section dispoed above said lower wheel conveyor section in symmetrical relationship therewith so as to define a path of travel therebetween of a sheet of steel to be cooled, (c) a reversible drive unit drivingly coupled to said lower wheel conveyor section so that said sheet of steel placed thereon may be reciprocated lengthwise, (d) lower and upper water spraying systems disposed immediately below and above said lower and upper wheel conveyor sections, respectively, each of said lower and upper water spraying systems including an array of water spray nozzles directed toward said sheet of steel, (e) each of said water spray nozzles being constructed whereby the cooling water fed into the inlet of the spray nozzle is divided into two flows or jets having different vectors, and said two flows or jets strike against each other just within the orifice of the spray nozzle, whereby the cooling water may be atomized or broken up into extremely fine droplets only under the pressure of the cooling water, (f) each of said spray nozzles being provided with spray-direction control means which causes the associated spray nozzle to change the spray direction or the axis of said associated spray nozzle through a predetermined angle range in a plane widthwise and perpendicular to said sheet of steel on said lower wheel conveyor section in response to deformations of said sheet of steel, (g) a vertical drive unit for moving said upper wheel conveyor section up and down in unison with said upper water spraying system, (h) a cooling water supply system for supplying the cooling water under pressure to said array of spray nozzles in each of said lower and upper water spraying systems, the spray nozzles in each of said lower and upper water spraying systems being divided into at least two groups in the lengthwise direction of said apparatus, and (i) flow control means for supplying cooling water to each of said groups of spray nozzles.

2. An apparatus as set forth in claim 1 wherein each of said water spray nozzles comprises a hollow main body, and deflector means which is disposed within said hollow main body and which has an axial water flow passage extended axially thereof and a helical water flow passage formed in the cylindrical surface thereof.

3. An apparatus as set forth in claim 1 or 2 wherein said spray-direction control means further comprises (a) a 90° long turn elbow-like section having a vertical portion with a water spray nozzle fitted at the lower end thereof and a horizontal portion extended in parallel with the longitudinal axis of said apparatus and hydraulically connected to said cooling water supply system through flexible rotation joint means, (b) a disk securely mounted coaxially on said horizontal portion of said 90° long turn elbow-like section, (c) a link mechanism with its upper end pivoted to said disk, and (d) a link lifting mechanism which is connected to the lower end of said link mechanism and which is caused to be pushed upward when said sheet is deformed beyond a predetermined extent, thereby causing said elbow-like section to rotate in the direction in which the angle of inclination of the spray nozzle is increased.

4. An apparatus as set forth in claim 3 further comprises a sleeve nut and wherein said link mechanism is divided and connected with said sleeve nut having oppositely threaded screw threads.

5. An apparatus as set forth in claim 3 wherein said link lifting mechanism further comprises a touch roller which engages said sheet and is caused to rotate by the reciprocal movement of said sheet, and a slider to which is pivoted said touch roller and which may be pushed upward by said sheet.

6. An apparatus as set forth in claim 4 wherein said link lifting mechanism further comprises a touch roller which engages said sheet and is caused to rotate by the reciprocal movement of said sheet, and a slider to which is pivoted said touch roller and which may be pushed upward by said sheet.

* * * * *